US011271337B2

(12) United States Patent
Huang et al.

(10) Patent No.: US 11,271,337 B2
(45) Date of Patent: Mar. 8, 2022

(54) CONNECTOR

(71) Applicant: DONGGUAN LUXSHARE TECHNOLOGIES CO., LTD, Dongguan (CN)

(72) Inventors: Bin Huang, Dongguan (CN); Rongzhe Guo, Dongguan (CN); Chenhui Zeng, Dongguan (CN); Hongji Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/105,920

(22) Filed: Nov. 27, 2020

(65) Prior Publication Data

US 2021/0305738 A1 Sep. 30, 2021

(30) Foreign Application Priority Data

Mar. 31, 2020 (CN) ..... 202020446312.6

(51) Int. Cl.

| | |
|---|---|
| ***H01R 12/73*** | (2011.01) |
| ***H01R 12/70*** | (2011.01) |
| ***H01R 13/502*** | (2006.01) |
| ***H01R 13/11*** | (2006.01) |

(52) U.S. Cl.

CPC ..... *H01R 12/73* (2013.01); *H01R 12/7052* (2013.01); *H01R 13/11* (2013.01); *H01R 13/502* (2013.01)

(58) Field of Classification Search

CPC ..... H01R 12/7082; H01R 12/73; H01R 12/7052; H01R 13/11; H01R 13/502

See application file for complete search history.

(56) References Cited

U.S. PATENT DOCUMENTS

| | | | | |
|---|---|---|---|---|
| 5,171,154 | A * | 12/1992 | Casciotti | H01R 12/7082 439/260 |
| 10,193,255 | B2 * | 1/2019 | Ito | H01R 12/87 |
| 10,468,808 | B2 * | 11/2019 | Duan | H01R 13/6585 |
| 10,594,065 | B2 * | 3/2020 | Toh | H01R 13/405 |
| 11,171,445 | B1 * | 11/2021 | Shen | H01R 13/502 |
| 2018/0351282 | A1 * | 12/2018 | Duan | H01R 13/6585 |
| 2019/0097336 | A1 * | 3/2019 | Toh | H01R 12/721 |
| 2020/0381869 | A1 * | 12/2020 | Long | H01R 13/6471 |
| 2021/0305738 | A1 * | 9/2021 | Huang | H01R 12/7052 |

* cited by examiner

*Primary Examiner* — Abdullah A Riyami
*Assistant Examiner* — Nader J Alhawamdeh
(74) *Attorney, Agent, or Firm* — Birch, Stewart, Kolasch & Birch, LLP

(57) ABSTRACT

A connector includes an insulating body and a terminal assembly. Where the terminal assembly includes a plurality of conductive terminals that are disposed side by side in the insulating body; a front end of each of the plurality of conductive terminals protrudes to form a first contact point and a second contact point, which are along a docking direction of the connector spaced apart on a same side of the each of the plurality of conductive terminals in sequence; and after the connector is docked with a docking connector, both the first contact point and the corresponding second contact point abut on a same docking terminal of the docking connector.

8 Claims, 8 Drawing Sheets

CONNECTOR

CROSS-REFERENCE TO RELATED APPLICATION

This application claims priority to a Chinese patent application No. 202020446312.6 filed on Mar. 31, 2020, disclosure of which is incorporated herein by reference in its entirety.

TECHNICAL FIELD

The present disclosure relates to the technical field of connectors and, in particular, to a connector.

BACKGROUND

In a high-speed connector, a front end of a conductive terminal of the connector is generally bent downward, and is formed with a contact point to abut on a docking terminal of a docking connector, so as to connect the two connectors. After the two connectors are completely docked, a distance between the contact point of the conductive terminal and a docking edge of the docking terminal that is abutted on the contact point of the conductive terminal is stub, which has a crucial impact on signal integrity (SI) performance of the connector. In a design process, the stub is shortened as much as possible to improve the SI performance of the connector.

However, a length of the stub of the connector in the related art is relatively large, resulting in poor SI performance of the connector.

SUMMARY

An objective of the present disclosure is to provide a connector capable of shortening a length of a stub of the connector, thereby greatly improving the SI performance of the connector.

A connector is provided and includes an insulating body and a terminal assembly. The terminal assembly includes a plurality of conductive terminals that are disposed side by side in the insulating body. A front end of each of the plurality of conductive terminals protrudes to form a first contact point and a second contact point are spaced apart on a same side of the each of the plurality of conductive terminals along a docking direction of the connector. After the connector is docked with a docking connector, both the first contact point and the second contact point abut on a same docking terminal of the docking connector.

Alternatively, the first contact point and the corresponding second contact point are connected to form a contact plane.

Alternatively, a groove is formed between the first contact point and the corresponding second contact point.

Alternatively, the connector further includes a first insulating block, where each of the plurality of conductive terminals includes a connecting portion and a docking portion that are connected to each other at an angle, the first contact point and the second contact point are both disposed on the docking portion, and the first insulating block is formed outside the connecting portion and disposed in the insulating body.

Alternatively, an accommodating cavity is disposed on the insulating body, a first sliding groove is disposed at a bottom of each of two sidewalls of the accommodating cavity, the first insulating block is disposed in the accommodating cavity, and an end portion of the first insulating block is inserted into the first sliding groove.

Alternatively, the connector further includes a second insulating block, where the second insulating block is formed outside the docking portion, both the first contact point and the second contact point are exposed to the second insulating block, and the second insulating block is disposed in the insulating body.

Alternatively, a second sliding groove is disposed at a top of each of two sidewalls of the accommodating cavity, the second insulating block is disposed in the accommodating cavity, and an end portion of the second insulating block is inserted into the second sliding groove.

Alternatively, a front end of the insulating body is provided with a docking groove, and a front end of the docking portion is disposed in the docking groove and is located on a side adjacent to a top wall of the docking groove.

Alternatively, a limit pillar is provided at a bottom of the insulating body. When the connector is mounted on a circuit board, a limit hole mated with the limit pillar is disposed on the circuit board, the circuit board is fixed at the bottom of the insulating body, and the limit pillar is configured to extend into the limit hole.

Alternatively, the connector further includes a metal sheet, where a fixed hole is disposed on the metal sheet, and the metal sheet is sleeved on the limit pillar and disposed between the insulating body and the circuit board.

Reference list

Figure 1:
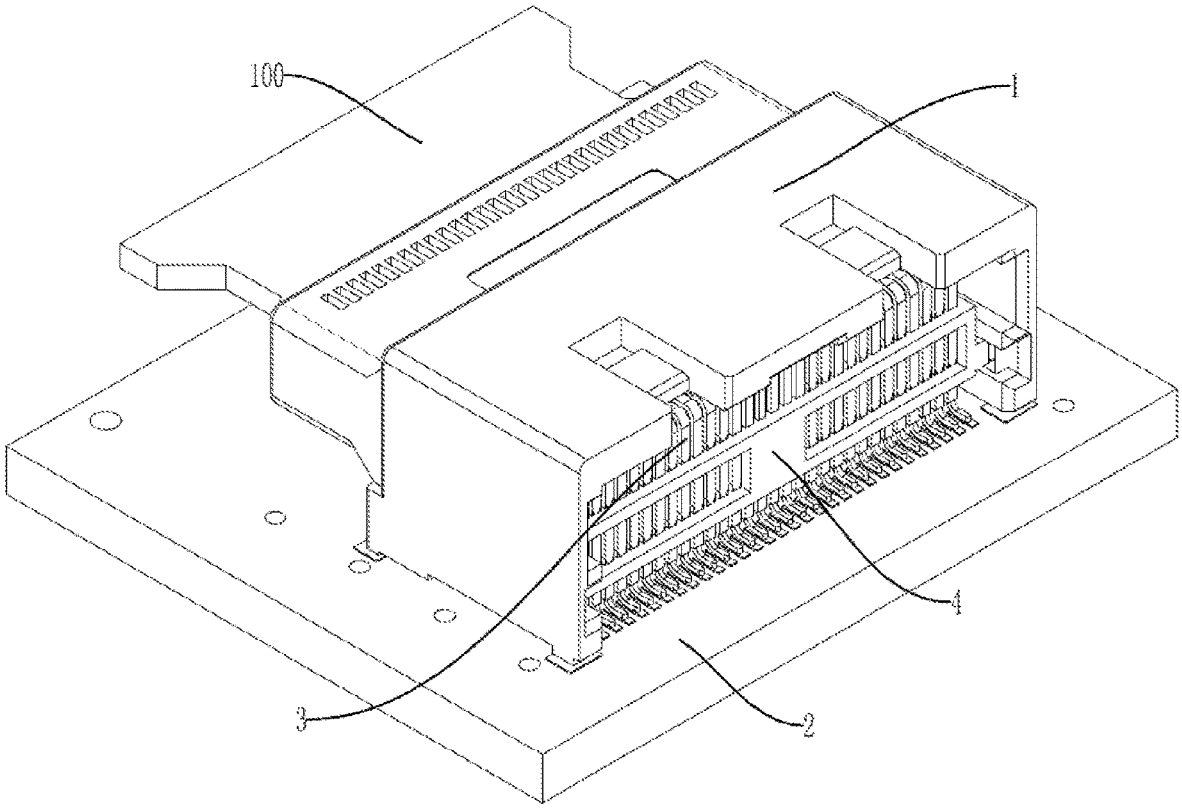
FIG. 1 is a schematic structure view illustrating a connector connected to a docking connector according to the present disclosure.

| | | | |
|---|---|---|---|
| 100 | docking connector | 3 | conductive terminal |
| 101 | docking terminal | 31 | docking portion |
| 1 | insulating body | 311 | first contact point |
| 11 | accommodating cavity | 312 | second contact point |
| 12 | first sliding groove | 32 | connecting portion |
| 13 | second sliding groove | 4 | first insulating block |
| 14 | limit pillar | 41 | first plug-in sliding block |
| 15 | connecting boss | 5 | second insulating block |
| 151 | connecting groove | 51 | second plug-in sliding block |
| 2 | circuit board | 6 | metal sheet |
| 21 | limit hole | 61 | connecting sheet |

DETAILED DESCRIPTION

To illustrate the objective, technical solutions and advantages of the present disclosure more clearly, the technical solution of the present disclosure will be described clearly and completely in conjunction with drawings of the present disclosure. Apparently, the embodiments described below are part, not all, of embodiments of the present disclosure. Generally, the assemblies of the embodiment of the present disclosure described and illustrated in the drawings herein may be arranged and designed through various configurations.

Therefore, the following detailed description of the embodiments of the present disclosure and shown in the drawings is not intended to limit the scope of the present disclosure, but merely illustrates the selected embodiments of the present disclosure. Based on the embodiments of the present utility mode, all other embodiments obtained by those of ordinary skill in the art are within the scope of the present utility mode on the premise that no creative work is done.

It is to be noted that similar reference numerals and letters indicate similar items in the subsequent drawings, and therefore, once a particular item is defined in a drawing, the item needs no more definition and explanation in subsequent drawings.

In the description of the present disclosure, it is to be noted that the orientational or positional relationships indicated by terms "above", "below", "left", "right", "vertical", "horizontal", "inside", "outside" and the like are based on the orientational or positional relationships illustrated in the drawings or the orientational or positional relationship that products of the present disclosure are usually used in, which are for the mere purpose of facilitating and simplifying the description of the present disclosure and do not indicate or imply that the apparatus or element referred to has a specific orientation and is constructed and operated in a specific orientation, and thus it is not to be construed as limiting the present disclosure. Moreover, terms "first", "second" and "third" are merely for distinguishing the description and are not to be construed as indicating or implying relative importance. In the description of the present disclosure, unless otherwise noted, "a plurality of" means two or more.

In the description of the present disclosure, it is further to be noted that, unless otherwise expressly specified and limited, terms "dispose" and "connection" should be understood in a broad sense, for example, may be a secured connection, a detachable connection or an integrated connection, or may be a mechanical connection or an electrical connection. For those of ordinary skill in the art, specific meanings of the above terms in the present disclosure can be understood according to specific conditions.

In the present disclosure, unless otherwise expressly specified and limited, when a first feature is described as "on" or "below" a second feature, the first feature and the second feature may be in direct contact, or be in contact via another feature between the two features instead of being in direct contact. Moreover, when the first feature is described as "on", "above" or "over" the second feature, the first feature is right on, above or over the second feature or the first feature is obliquely on, above or over the second feature, or the first feature is simply at a higher level than the second feature. When the first feature is described as "under", "below" or "underneath" the second feature, the first feature is right under, below or underneath the second feature or the first feature is obliquely under, below or underneath the second feature, or the first feature is simply at a lower level than the second feature.

Embodiments in accordance with the present disclosure will now be described in detail below. Examples of the embodiments are illustrated in the drawings, where the same or similar reference numerals indicate the same or similar elements or elements having the same or similar functions. The embodiments described below with reference to the drawings are exemplary, merely to explain the present disclosure, and not to be construed as limiting the present disclosure.

As shown in FIGS. 1 to 8, the present embodiment discloses a connector, which includes an insulating body 1, a circuit board 2, and a terminal assembly.

Figure 2:
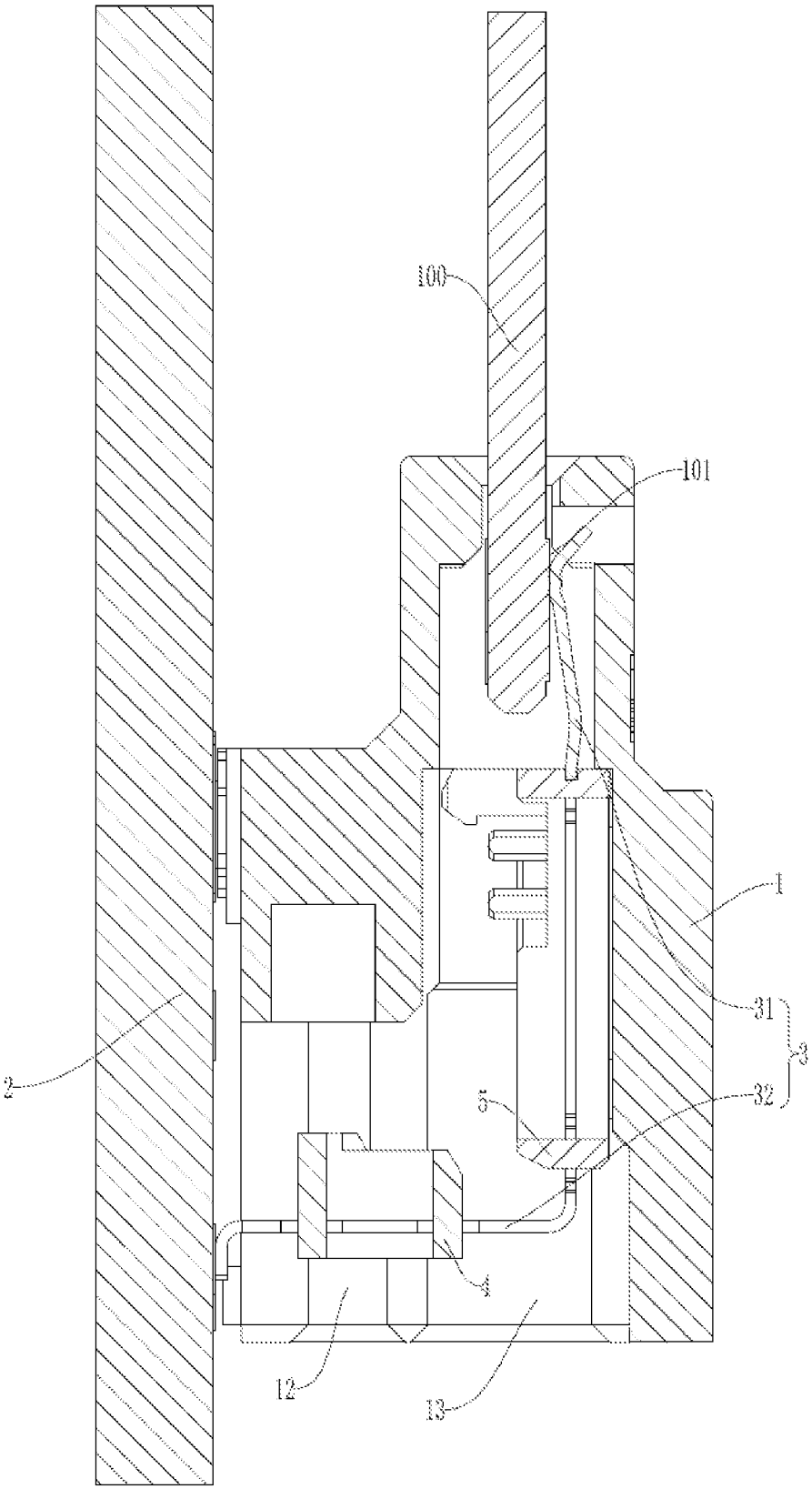
FIG. 2 is a cross-sectional view illustrating the connector connected to the docking connector according to the present disclosure.
Figure 3:
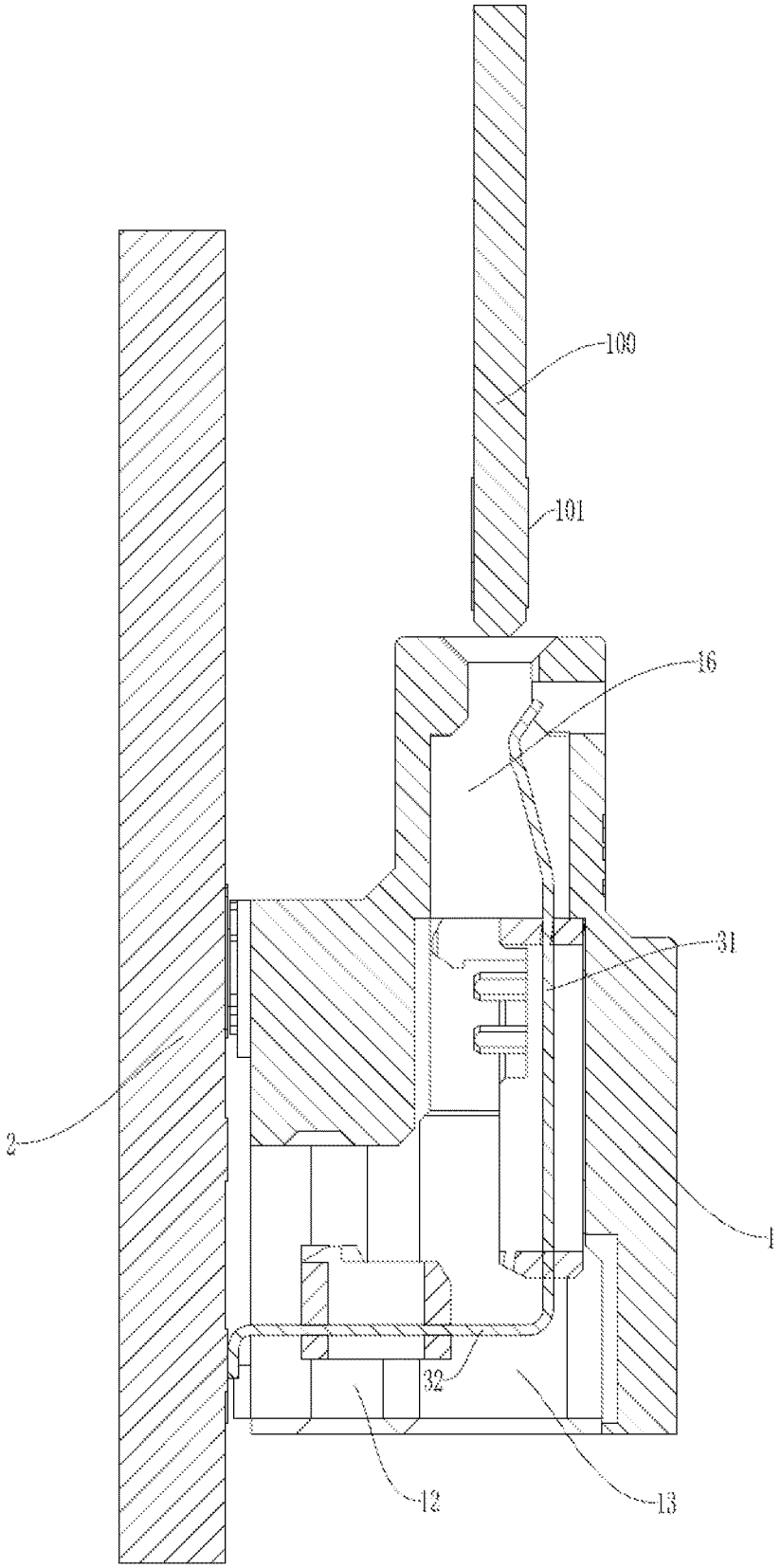
FIG. 3 is a cross-sectional view illustrating the connector that is not connected to the docking connector according to the present disclosure.

As shown in FIGS. 1 to 3, the circuit board 2 is fixed to the insulating body 1. The terminal assembly includes a plurality of conductive terminals 3 that are disposed side by side in the insulating body 1. A tail end of each conductive terminal 3 is connected to the circuit board 2, a pad mated with each conductive terminal 3 is disposed on the circuit board 2, and the tail end of each conductive terminal 3 is welded to the pad. A front end of each conductive terminal 3 protrudes to form a first contact point 311 and a second contact point 312, which are spaced apart on a same side of each conductive terminal 3 along a docking direction of the connector. After the connector is docked with a docking connector 100, both a first contact point 311 and a second contact point 312 of a same conductive terminal 3 abut on a same docking terminal 101 of the docking connector 100.

When the connector is docked with the docking connector 100, the first contact point 311 first contacts the docking terminal 101 of the docking connector 100. With continuous insertion of the docking connector 100, the conductive terminal 3 is elastically deformed so that the first contact point 311 and the second contact points 312 both move away from the docking terminal 101 of the docking connector 100. An amount of movement of the first contact point 311 is greater than that of the second contact point 312, making the second contact point 312 also abut on the docking terminal 101 of the docking connector 100, so that the first contact point 311 and the second contact point 312 both abut on the same docking terminal 101 of the docking connector 100. Since the conductive terminal 3 is provided with the second contact point 312 behind the first contact point 311, the stub is a distance between the second contact point 312 and a docking edge of the docking terminal 101 that is abutted on the second contact point 312. This design shortens a length of the stub, thereby greatly improving SI performance of the connector.

Figure 4:
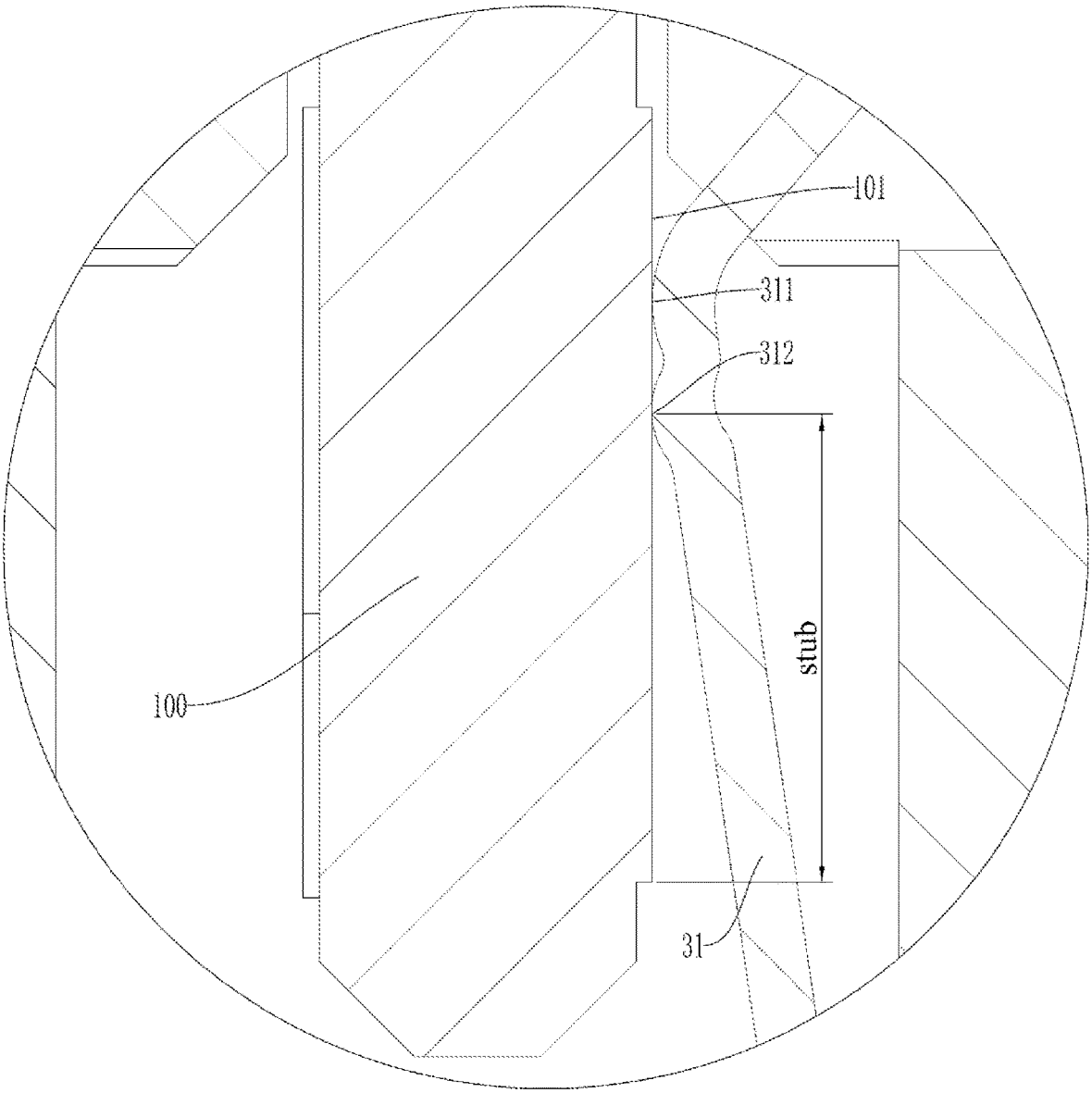
FIG. 4 is a partial cross-sectional view illustrating the connector with a groove formed between a first contact point and a second contact point according to the present disclosure.

As shown in FIG. 4, alternatively, in the present embodiment, a groove is formed between the first contact point 311 and the second contact point 312. That is, two protrusions are formed on the conductive terminal 3 by stamping and bending twice to form the first contact point 311 and the second contact point 312.

Figure 5:
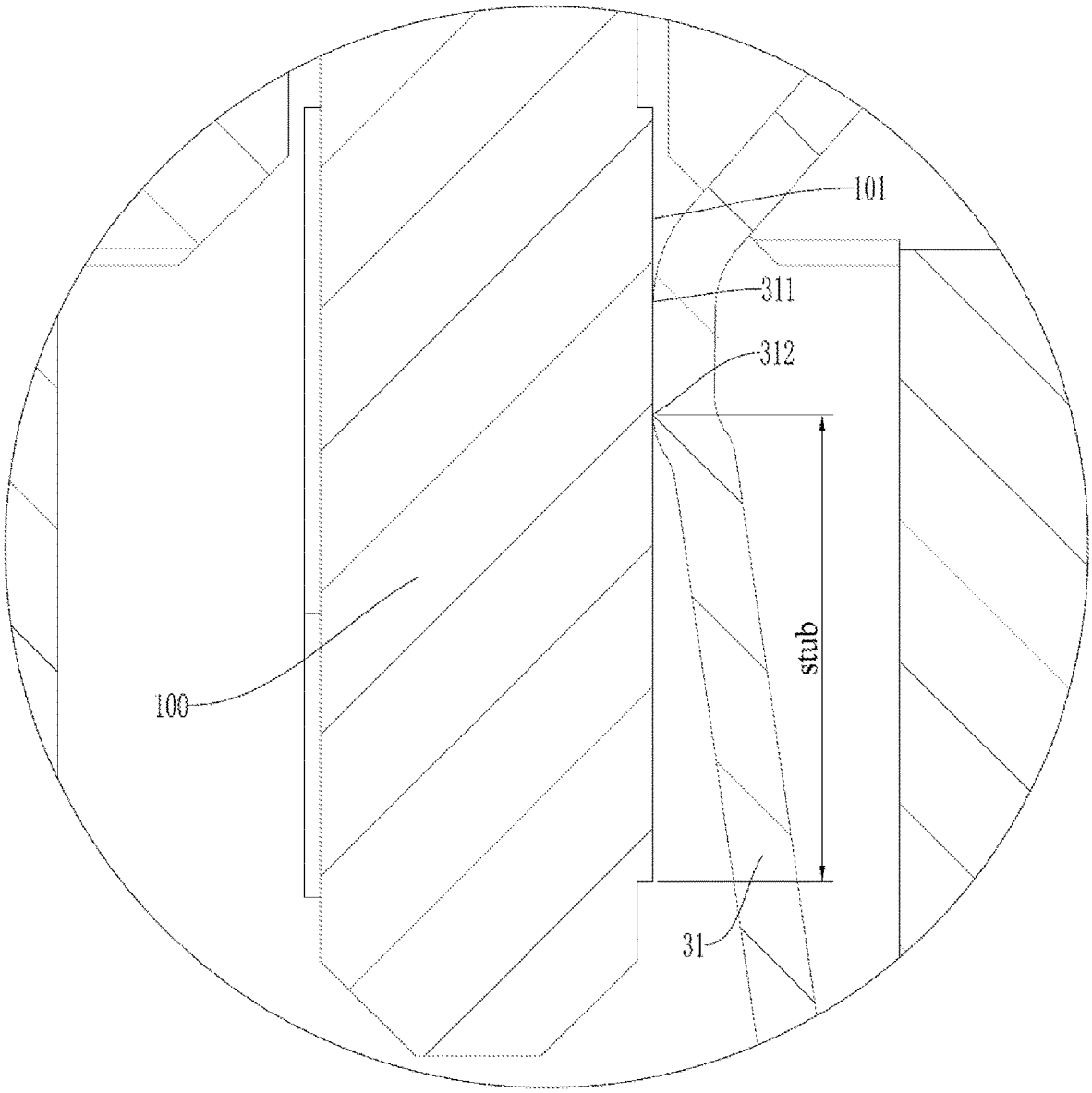
FIG. 5 is a partial cross-sectional view (illustrating the connector in which the first contact point and the second contact point are connected to form a contact plane according to the present disclosure.

As shown in FIG. 5, in other embodiments, a flat bottom groove may also be formed by stamping and bending at the front end of the conductive terminal 3, and two end points on an outer lateral side of the flat bottom groove are the first contact point 311 and the second contact point 312, respectively. That is, the first contact point 311 and the second contact point 312 are connected to form a contact plane. After the connector is docked with the docking connector 100, the plane where the first contact point 311 and the second contact point 312 are located abut on the docking terminal 101 of the docking connector 100.

A front end of the insulating body 1 is provided with a docking groove, and a front end of a docking portion 31 is disposed in the docking groove and is located on a side adjacent to a top wall of the docking groove. When the docking connector 100 is plugged into the connector, the front end of the conductive terminal 3 is configured to move upward. In other embodiments, the docking portion 31 may also be located on a side adjacent to a bottom wall of the docking groove, and when the docking connector 100 is plugged into the connector, the front end of the conductive terminal 3 is configured to move downward.

Figure 6:
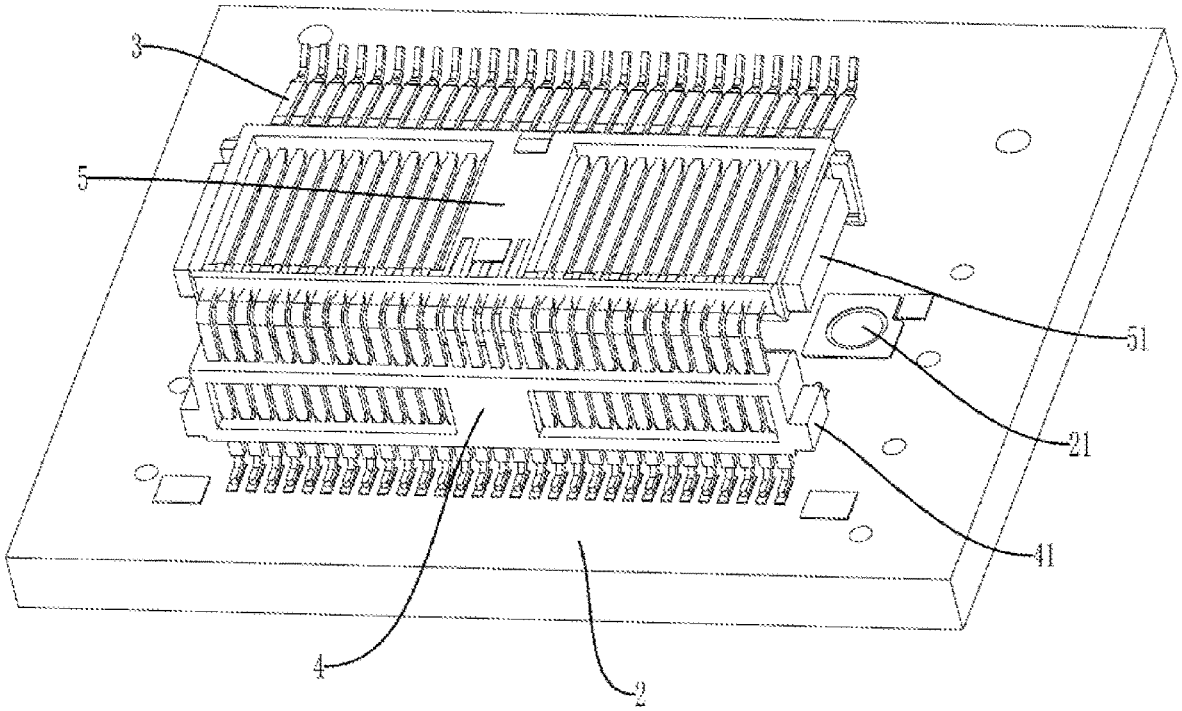
FIG. 6 is a first partial schematic structure view illustrating the connector according to the present disclosure.
Figure 7:
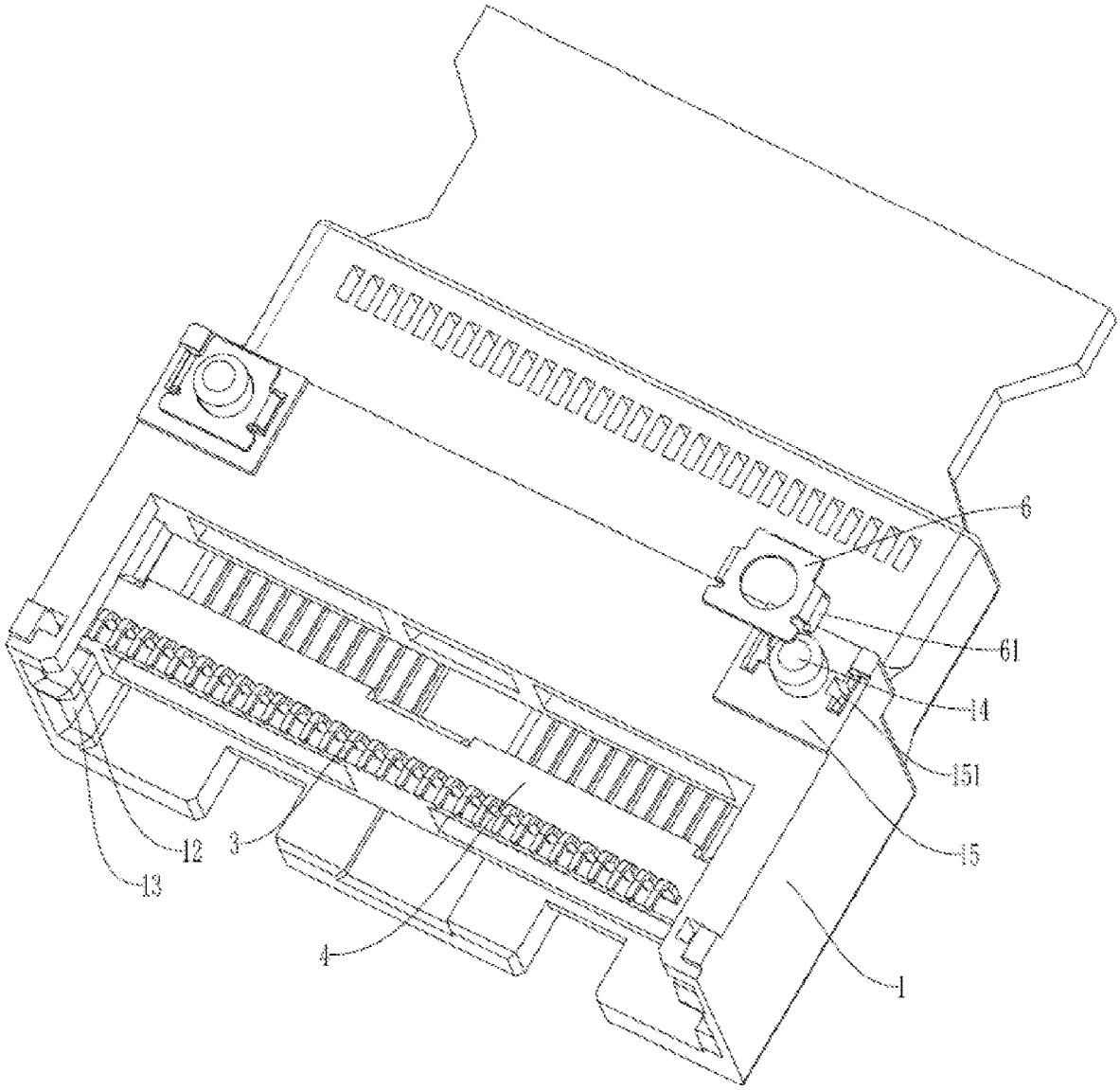
FIG. 7 is a second partial schematic structure view illustrating the connector according to the present disclosure.

As shown in FIGS. 6 and 7, a limit pillar 14 is provided at a bottom of the insulating body 1. Specifically, a connecting boss 15 is provided at the bottom of the insulating body 1, and the limit pillar 14 is provided on the connecting boss 15. The circuit board 2 is provided with a limit hole 21 mated with the limit pillar 14 and is fixed to the bottom of the insulating body 1, and the limit pillar 14 is configured to extend into the limit hole 21. The connector further includes a metal sheet 6 on which a fixed hole is provided, and the metal sheet 6 is sleeved on the limit pillar 14. Two connecting grooves 151 are provided on the connecting boss 15. A connecting sheet 61 is formed by bending on the metal sheet 6, and inserted into the connecting groove 151 to fix the metal sheet 6 to the insulating body 1, where the metal sheet 6 is provided between the insulating body 1 and the circuit board 2.

As shown in FIGS. 2 and 3, optionally, the connector further includes a first insulating block 4 and a second insulating block 5. The conductive terminal 3 includes a connecting portion 32 and the docking portion 31 which are connected to each other and disposed at an angle. In the present embodiment, the connecting portion 32 and the docking portion 31 are disposed at a right angle. The connecting portion 32 is connected to the circuit board 2, the pad is provided on the circuit board 2, and an end of the connecting portion 32, which is away from the docking portion 31, is welded to the circuit board 2.

Figure 8:
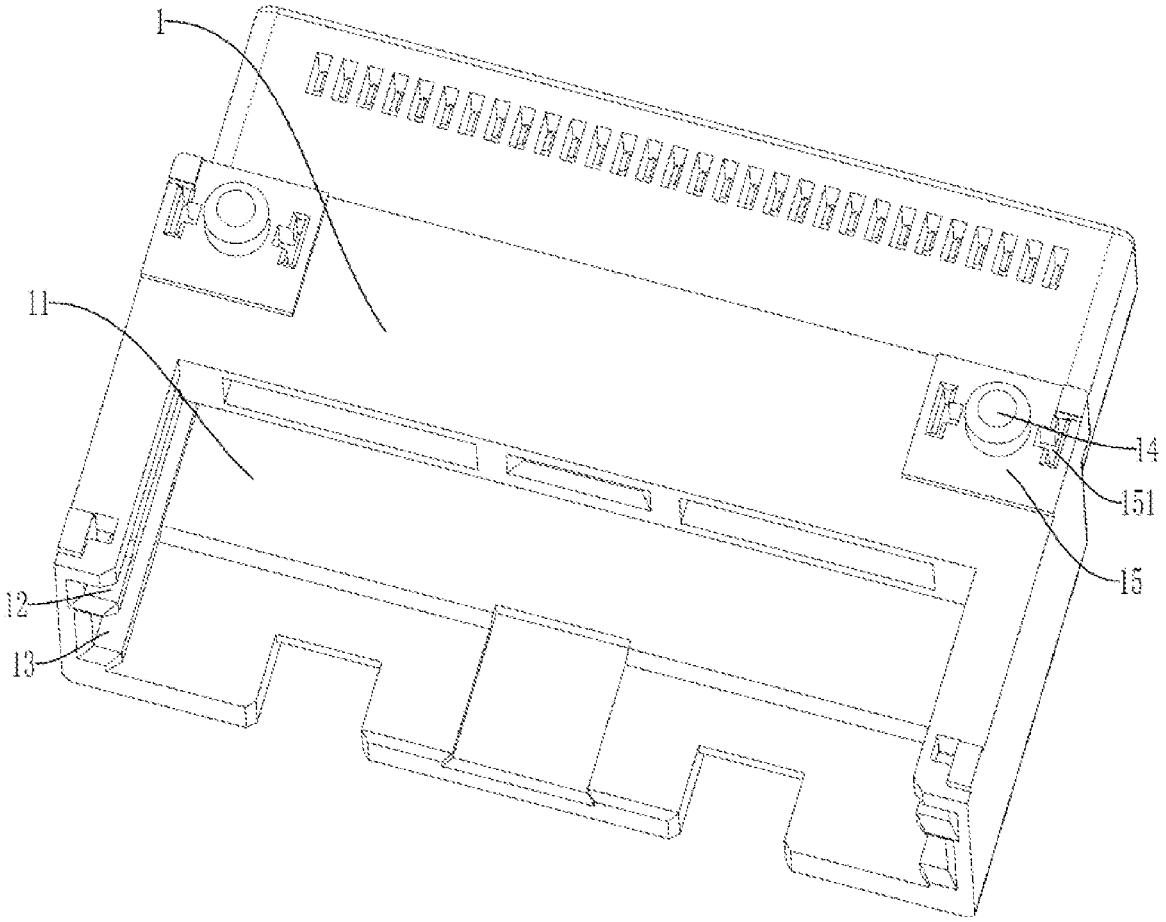
FIG. 8 is a schematic structure view illustrating an insulating body according to the present disclosure.

Both the first contact point 311 and the second contact point 312 are provided on the docking portion 31, the first insulating block 4 is formed outside the connecting portion 32, and a middle portion of the connecting portion 32 is located in the first insulating block 4. The second insulating block 5 is formed outside the docking portion 31, and an end of the docking portion 31 adjacent to the connecting portion 32 is located in the second insulating block 5. As shown in FIG. 8, the insulating body 1 is provided with an accommodating cavity 11, and both the first insulating block 4 and the second insulating block 5 are disposed in the accommodating cavity 11 of the insulating body 1. A first sliding groove 12 is disposed at a bottom of each of two sidewalls of the accommodating cavity 11, and a second sliding groove 13 is disposed at a top of each of two sidewalls of the accommodating cavity 11, where both the first sliding groove 12 and the second sliding groove 13 are provided in a front-back direction. A left end and a right end of the first insulating block 4 are each provided with a first plug-in sliding block 41, and a left end and a right end of the second insulating block 5 are each provided with a second plug-in sliding block 51. An end portion of the first insulating block 4 is inserted into the first sliding groove 12, that is, the first plug-in sliding block 41 is slidably disposed in the first sliding groove 12. An end portion of the second insulating block 5 is inserted into the second sliding groove 13, that is, the second plug-in sliding block 51 is slidably disposed in the second sliding groove 13.

An assembly process of the connector: the first insulating block 4 and the second insulating block 5 are formed on the conductive terminal 3; the first insulating block 4, the second insulating block 5 and the terminal assembly are inserted into the accommodating cavity 11 and the docking groove of the insulating body 1 from a rear end of the insulating body 1, the first plug-in sliding block 41 of the first insulating block 4 slides forward along the first sliding groove 12, and the second plug-in sliding block 51 of the second insulating block 5 slides forward along the second sliding groove 13; and then the circuit board 2 is fixed to the bottom of the insulating body 1 via the limit hole 21 of the limit pillar 14. Then the conductive terminal 3 is welded to the circuit board 2. The first sliding groove 12 limits an up-down direction and a left-right direction of the first insulating block 4, and the second sliding groove 13 limits an up-down direction and a left-right direction of the second insulating block 5. An end of the conductive terminal 3 is welded onto the circuit board 2 fixed to the insulating body 1, and the conductive terminal 3 limits a front-rear direction of the first insulating block 4 and the second insulating block 5. The two cooperate to fix the first insulating block 4 and the second insulating block 5 into the insulating body 1, so that the conductive terminal 3 is fixed into the insulating body 1.

Apparently, the above embodiments of the present disclosure are merely examples to illustrate the present disclosure and are not intended to limit embodiments of the present disclosure. For those of ordinary skill in the art, alterations or modifications in other different forms can be made based on the above description. Embodiments cannot be and do not need to be exhausted herein. Any modifications, equivalent substitutions and improvements within the spirit and principle of the present disclosure fall within the scope of the claims of the present disclosure.

What is claimed is:

1. A connector, comprising: an insulating body; and a terminal assembly comprising a plurality of conductive terminals that are disposed side by side in the insulating body, wherein a front end of each of the plurality of conductive terminals protrudes to form a first contact point and a second contact point which are along a docking direction of the connector spaced apart on a same side of the each of the plurality of conductive terminals in sequence; and after the connector is docked with a docking connector, both the first contact point and the corresponding second contact point abut on a same docking terminal of the docking connector, further comprising a first insulating block disposed in the insulating body, wherein each of the plurality of conductive terminals comprises a connecting portion and a docking portion that are connected to each other at an angle, the first contact point and the second contact point are both disposed on the docking portion, and the first insulating block is formed outside the connecting portions, wherein the insulating body is provided with an accommodating cavity, a first sliding groove is disposed at a bottom of each of two sidewalls of the accommodating cavity, the first insulating block is disposed in the accommodating cavity, and end portions of the first insulating block are inserted into the two first sliding grooves respectively.

2. The connector according to claim 1, wherein the first contact point and the corresponding second contact point are connected to form a contact plane.

3. The connector according to claim 1, wherein a groove is formed between the first contact point and the corresponding second contact point.

4. The connector according to claim 1, further comprising a second insulating block disposed in the insulating body, wherein the second insulating block is formed outside the docking portions, and both the first contact point and the second contact point are exposed to the second insulating block.

5. The connector according to claim 4, wherein a second sliding groove is disposed at a top of each of two sidewalls of the accommodating cavity, the second insulating block is disposed in the accommodating cavity, and end portions of the second insulating block are inserted into the two second sliding grooves.

6. The connector according to claim 5, wherein a docking groove is disposed at a front end of the insulating body, and a front end of the docking portion is disposed in the docking groove and is located at a side adjacent to a top wall of the docking groove.

7. The connector according to claim 1, wherein a limit pillar is disposed at a bottom of the insulating body; in a case where the connector is mounted on a circuit board, the circuit board is provided with a limit hole mated with the limit pillar, and the limit pillar is configured to extend into the limit hole while the circuit board is fixed at the bottom of the insulating body.

8. The connector according to claim 7, further comprising a metal sheet, wherein the metal sheet is provided with a fixed hole for sleeving the metal sheet on the limit pillar, and the metal sheet is disposed between the insulating body and the circuit board.

* * * * *